US011070909B2

(12) United States Patent
Zheng et al.

(10) Patent No.: US 11,070,909 B2
(45) Date of Patent: Jul. 20, 2021

(54) SPEAKER APPARATUS, METHOD FOR PROCESSING INPUT SIGNALS THEREOF, AND AUDIO SYSTEM

(71) Applicants: Jianwen Zheng, Shenzhen (CN); Shengbo Li, Shenzhen (CN)

(72) Inventors: Jianwen Zheng, Shenzhen (CN); Shengbo Li, Shenzhen (CN)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 16/640,020

(22) PCT Filed: Aug. 31, 2017

(86) PCT No.: PCT/CN2017/099837

§ 371 (c)(1),
(2) Date: Feb. 18, 2020

(87) PCT Pub. No.: WO2019/041212

PCT Pub. Date: Mar. 7, 2019

(65) Prior Publication Data

US 2020/0245063 A1 Jul. 30, 2020

(51) Int. Cl.

| | |
|---|---|
| ***H04R 5/02*** | (2006.01) |
| ***H04R 1/40*** | (2006.01) |
| ***H04R 1/30*** | (2006.01) |

(52) U.S. Cl.

CPC ..... *H04R 1/403* (2013.01); *H04R 1/30* (2013.01); *H04R 2201/403* (2013.01); *H04R 2203/12* (2013.01)

(58) Field of Classification Search

CPC ..... H04R 5/02

See application file for complete search history.

(56) References Cited

U.S. PATENT DOCUMENTS

| | | | | |
|---|---|---|---|---|
| 8,638,959 | B1 | 1/2014 | Hall | |
| 9,264,813 | B2 * | 2/2016 | Riggs | H04R 5/02 |
| 2006/0078129 | A1 | 4/2006 | Nakamichi | |

(Continued)

FOREIGN PATENT DOCUMENTS

| | | | |
|---|---|---|---|
| CN | 1636420 | A | 7/2005 |
| CN | 101031164 | A | 9/2007 |

(Continued)

*Primary Examiner* — Olisa Anwah

(74) *Attorney, Agent, or Firm* — Angela M. Brunetti

(57) ABSTRACT

A speaker apparatus, a method for processing input signals of the speaker apparatus and an audio system are provided. The speaker apparatus includes: a first plurality of speakers, arranged at an interval in a row, where acoustic energy radiation generated by the first plurality of speakers is greater in a first zone than in a second zone in a first frequency range; a second plurality of speakers, symmetrically disposed at two sides of the first plurality of speakers with openings at the two sides facing outwardly, where acoustic energy radiation generated by the second plurality of speakers is greater in a third zone than in a fourth zone in a second frequency range; and the first frequency range overlaps with the second frequency range. Therefore, the speaker apparatus, the method and the audio system can achieve a wide spacious effect and provide a near-real surround experience to listeners.

18 Claims, 9 Drawing Sheets

(56) References Cited

U.S. PATENT DOCUMENTS

| | | | |
|---|---|---|---|
| 2007/0199766 | A1 | 8/2007 | Iwayama |
| 2011/0019844 | A1 | 1/2011 | Chang |
| 2011/0116641 | A1 | 5/2011 | Bergere |
| 2012/0051568 | A1 | 3/2012 | Kim et al. |
| 2012/0076306 | A1 | 3/2012 | Aarts et al. |
| 2018/0317003 | A1 | 11/2018 | Chang et al. |

FOREIGN PATENT DOCUMENTS

| | | | |
|---|---|---|---|
| CN | 101964937 | A | 2/2011 |
| CN | 102113351 | A | 6/2011 |
| CN | 102196334 | A | 9/2011 |
| CN | 102387459 | A | 5/2012 |
| CN | 102461212 | A | 5/2012 |
| CN | 103583053 | A | 2/2014 |
| CN | 104378713 | A | 2/2015 |
| DE | 4036152 | A1 | 5/1992 |
| JP | 3164791 | U | 12/2010 |
| WO | 9314607 | A1 | 7/1993 |
| WO | 2012142357 | A1 | 10/2012 |
| WO | 2016182184 | A1 | 11/2016 |

* cited by examiner

SPEAKER APPARATUS, METHOD FOR PROCESSING INPUT SIGNALS THEREOF, AND AUDIO SYSTEM

FIELD

One or more embodiments herein generally relate to acoustic energy radiation control field, and more particularly, to a speaker apparatus, a method for processing input signals of the speaker apparatus, and an audio system.

BACKGROUND

A conventional sound bar may be used in a home theater system. The conventional sound bar may provide a simpler configuration than a multi-channel surround-sound speaker system, such as 5.1, 7.1, etc. However, the conventional sound bar may fail to provide a surround sound experience over a wideband range. To a listener, the conventional sound bar may appear to produce a narrow sound field, which is limited to a small zone in a listening space.

There is, thus, a need to provide a surround sound experience over a wideband range in a simpler configuration than multi-channel surround-sound speaker systems.

SUMMARY

According to an embodiment, a speaker apparatus is provided. The speaker apparatus includes: a first plurality of speakers, arranged at an interval in a row, where acoustic energy radiation generated by the first plurality of speakers is greater in a first zone than in a second zone in a first frequency range; and a second plurality of speakers, symmetrically disposed at two sides of the row of the first plurality of speakers with openings at the two sides facing outwardly, where acoustic energy radiation generated by the second plurality of speakers is greater in a third zone than in a fourth zone in a second frequency range; and the first frequency range overlaps with the second frequency range.

In some embodiments, the first zone covers a side area of the row of the first plurality of speakers, the second zone covers an area in front or back of the row of the first plurality of speakers, the third zone covers an area where the openings of the second plurality of speakers face, and the fourth zone covers a side area of the second plurality of speakers.

In some embodiments, sound pressure produced by the first plurality of speakers is greater in the first zone than in the second zone in a frequency range of 150 Hz to 3 kHz.

In some embodiments, sound pressure produced by the second plurality of speakers is greater in the third area than in the fourth area in a frequency range of 2 kHz to 20 kHz.

In some embodiments, each of the second plurality of speakers includes a tweeter and a horn connected with the tweeter, and the horn includes an input opening connected with the tweeter, and an output opening facing outwardly.

In some embodiments, a ratio of a size of the output opening of the horn to a size of the input opening of the horn is greater than two.

In some embodiments, a length of the horn is greater than half of the interval between adjacent speakers in the row of the first plurality of speakers.

In some embodiments, the interval between adjacent speakers in the row of the first plurality of speakers ranges from 2 cm to 16 cm, and length of the horn ranges from 2 cm to 16 cm.

In some embodiments, input signals of the first plurality of speakers are processed by a beamforming method based on Digital Signal Processing (DSP), so as to make the acoustic energy radiation generated by the first plurality of speakers greater in the first zone than in the second zone.

A method for processing input signals of a speaker apparatus is also provided according to embodiments, where the speaker apparatus includes a first plurality of speakers arranged at an interval in a row and a second plurality of speakers symmetrically disposed at two sides of the row of the first plurality of speakers with openings at the two sides facing outwardly, acoustic energy radiation of the first plurality of speakers is greater in a first zone than in a second zone in a first frequency range, acoustic energy radiation of the second plurality of speakers is greater in a third zone than in a fourth zone in a second frequency range, and the first frequency range overlaps with the second frequency range. The method includes: obtaining digital signals based on the input signals; filtering the digital signals to obtain first digital signals in the first frequency range and second digital signals in the second frequency range; and processing the first digital signals using a beamforming method based on Digital Signal Processing (DSP), to make the acoustic energy radiation generated by the first plurality of speakers greater in the first zone than in the second zone; where the processed first digital signals are adapted to be input to the first plurality of speakers, and the second digital signals are adapted to be input to the second plurality of speakers.

In some embodiments, the digital signals are filtered by a first filter and a second filter to obtain the first digital signals and the second digital signals respectively, and each of the second plurality of speakers includes a tweeter and a horn connected with the tweeter, determining a crossover frequency of the first filter and the second filter includes: determining the interval between adjacent speakers in the row of the first plurality of speakers; obtaining an upper frequency limit of the first plurality of speakers based on equation (1):

$$f_{uo} = \frac{c}{2\Delta x}, \tag{1}$$

where c is sound speed and Δx is the interval between the adjacent speakers in the row of the first plurality of speakers; determining length of the horn; obtaining a lower frequency limit of the second plurality of speakers based on equation (2):

$$f_{lh} = \frac{c}{4L_h}, \tag{2}$$

where c is sound speed and $L_h$ is the length of the horn; determining the crossover frequency based on the upper frequency limit and the lower frequency limit; and determining whether the determined crossover frequency matches with performance of the second plurality of speakers, if not, repeating the steps of determining the crossover frequency, if yes, the determined crossover frequency is determined to be the crossover frequency of the first filter and the second filter.

In some embodiments, the crossover frequency ranges from 800 Hz to 5 kHz.

In some embodiments, the method further includes obtaining first analog signals and second analog signals based on the processed first digital signals and the second digital signals; and amplifying the first analog signals and the second analog signals; where the amplified first analog signals are adapted to be input to the first plurality of speakers and the amplified second analog signals are adapted to be input to the second plurality of speakers.

In some embodiments, the first zone covers a side area of the row of the first plurality of speakers, the second zone covers an area in front or back of the row of the first plurality of speakers, the third zone covers an area where the openings of the second plurality of speakers face, and the fourth zone covers a side area of the second plurality of speakers.

An audio system is also provided according to embodiments. The audio system includes: a speaker apparatus including a first plurality of speakers arranged at an interval in a row, and a second plurality of speakers symmetrically disposed at two sides of the row of the first plurality of speakers with openings at the two sides facing outwardly, where acoustic energy radiation generated by the first plurality of speakers is greater in a first zone than in a second zone in a first frequency range, acoustic energy radiation generated by the second plurality of speakers is greater in a third zone than in a fourth zone in a second frequency range, and the first frequency range overlaps with the second frequency range; and a processor configured to process input signals of the speaker apparatus, where the processor includes: a first obtainment circuitry, configured to obtain digital signals based on the input signals; a first filter, configured to filter the digital signals to obtain first digital signals in the first frequency range; a second filter, configured to filter the digital signals to obtain second digital signals in the second frequency range; and a digital signal processing circuitry, configured to process the first digital signals using a beamforming method based on Digital Signal Processing (DSP), to make the acoustic energy radiation generated by the first plurality of speakers greater in the first zone than in the second zone; where the processed first digital signals are adapted to be input to the first plurality of speakers, and the second digital signals are adapted to be input to the second plurality of speakers.

In some embodiments, a crossover frequency of the first filter and the second filter ranges from 800 Hz to 5 kHz.

In some embodiments, the audio system further includes a second obtainment circuitry, configured to obtain first analog signals and second analog signals based on the processed first digital signals and the second digital signals; and an amplifier, configured to amplify the first analog signals and the second analog signals; where the amplified first analog signals are adapted to be input to the first plurality of speakers and the amplified second analog signals are adapted to be input to the second plurality of speakers.

In some embodiments, the first zone covers a side area of the row of the first plurality of speakers, the second zone covers an area in front or back of the row of the first plurality of speakers, the third zone covers an area where the openings of the second plurality of speakers face, and the fourth zone covers a side area of the second plurality of speakers.

By combining a first plurality of speakers and a second plurality of speakers together, the speaker apparatus and the audio system according to some embodiment can achieve a full-band surround effect.

Specifically, acoustic energy radiation generated by the first plurality of speakers is greater in the first zone than that in the second zone in the first frequency range, and acoustic energy radiation generated by the second plurality of speakers is greater in the third zone than that in the fourth zone in the second frequency range, where the first frequency range overlaps with the second frequency range, so that the speaker apparatus can overall generate acoustic energy radiation of strengthened directivity in a wideband range.

Further, the first zone covers a side area of the row of the first plurality of speakers, the second zone covers an area in front or back of the row of the first plurality of speakers, the third zone covers an area where the openings of the second plurality of speakers face, and the fourth zone covers a side area of the second plurality of speakers, so that the sideward acoustic energy radiation produced by the speaker apparatus is greater than the forward acoustic energy radiation produced by the speaker apparatus. When a listener is located in front of the speaker apparatus, sideward sound perceived by the listener is larger than forward sound perceived by the listener, which makes the sound field expanded and presents a surround experience to the listener.

Further, improved side firing speakers include two horn speakers disposed at two sides of the row of the first plurality of speakers with openings at the two sides facing outwardly, each of the two horn speakers includes a tweeter and a horn connected with the tweeter, and the horn includes an input opening connected with the tweeter, and an output opening facing outwardly, so that the sideward acoustic energy radiation of the two horn speakers can be strengthened while the forward acoustic energy radiation of two horn speakers can be constrained.

Further, input signals of the first plurality of speakers are processed by a beamforming method based on Digital Signal Processing (DSP) such as the Delay and Sum beamforming method or the sound pressure matching method, so that the first plurality of speakers can generate acoustic energy radiation of strengthened directivity.

Further, a method for processing input signals of the speaker apparatus is provided, where digital signals are obtained based on the input signals and then are filtered by a first filter and a second filter respectively, to obtain the first digital signals to be input to the first plurality of speakers and the second digital signals to be input to the second plurality of speakers, and the first digital signals are processed using a beamforming method based on Digital Signal Processing (DSP), so that the acoustic energy radiation generated by the first plurality of speakers can be greater in the first zone than in the second zone. A crossover frequency of the first filter and the second filter can be determined base on an upper frequency limit of the first plurality of speakers and a lower frequency limit of the horn speakers, which are related to parameters of the first plurality of speakers and parameters of the horn speakers respectively.

Further, an audio system including the speaker apparatus and a processor is provided, where the processor is configured to process input signals of the speaker apparatus. Specifically, the processor includes a first filter and a second filter which can filter the digital signals to obtain first digital signals in the first frequency range and to obtain second digital signals in the second frequency range, where the first digital signals are adapted to be input to the first plurality of speakers, and the second digital signals are adapted to be input to the second plurality of speakers; and the processor further includes a digital signal processing circuitry, which can process the first digital signals using a beamforming method based on DSP, so that the acoustic energy radiation generated by the first plurality of speakers can be greater in the first zone than in the second zone.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION OF EMBODIMENTS

Figure 1:
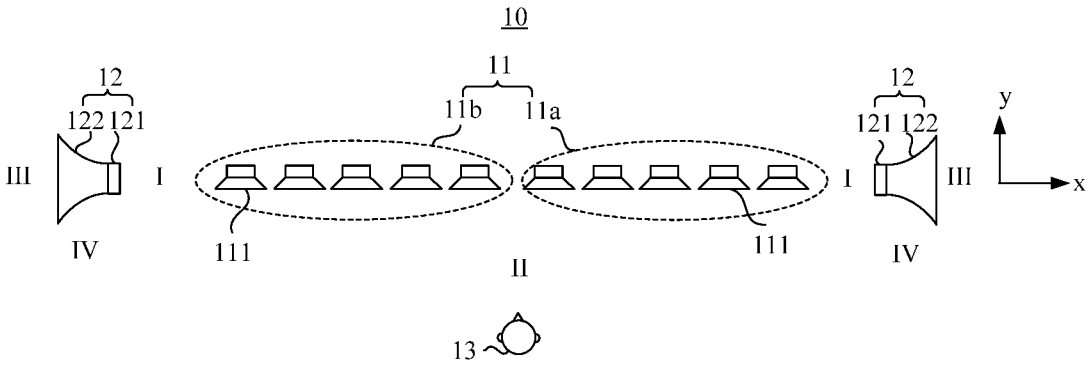
FIG. 1 schematically illustrates a structural diagram of a speaker apparatus 10 according to an embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and make part of this disclosure.

Surround experience of listeners can be improved by optimizing directivity of a speaker or a speaker array. A sharp directivity pattern in a wideband frequency range can yield a spacious effect and desirable surround experience. To achieve such, one or more embodiments herein include a speaker or speaker array that utilizes a beamforming method, which makes use of a beamforming method based on Digital Signal Processing (DSP), and an improved side firing method. Combining the beamforming method and the improved side firing method may result in the spacious effect and desirable surround experience. The combination may yield strengthened directivity over the wideband frequency range.

Referring to FIG. 1, FIG. 1 schematically illustrates a structural diagram of a speaker apparatus 10 according to an embodiment.

The speaker apparatus 10 includes a first plurality of speakers 11 and a second plurality of speakers 12, where the first plurality of speakers 11 include a first group of speakers 11*a* and a second group of speakers 11*b*, the first group of speakers 11*a* may be applied as a left channel and a second group of speakers 11*b* may be applied as a right channel, and the first group of speakers 11*a* and the second group of speakers 11*b* are symmetrically disposed.

In FIG. 1, the first group of speakers 11*a* and the second group of speakers 11*b* may include five first speakers 111 respectively, that is, there are ten first speakers 111 in total. It should be noted that, the number of the first speakers 111 can be changed in practice. In some embodiments, the first plurality of speakers 11 may be arranged in a row with an equal interval. In some embodiments, the first plurality of speakers 11 may be arranged in a curve, or in other ways.

The second plurality of speakers 12 may be disposed in two side areas of the first plurality of speakers 11 with openings at the two side areas facing outwardly. In the present embodiments, two second speakers 12 are illustrated in FIG. 1. It should be noted that, the number of speakers in the second plurality of speakers 12 can be changed in practice. Similarly, the second plurality of speakers 12 may be arranged in different ways, such as in a line or in a curve and so on.

In some embodiments, the interval between adjacent first speakers 111 in the first plurality of speakers ranges from 2 cm to 16 cm, and length of the row of the first plurality of speakers ranges from 20 cm to 2 m.

In some embodiments, input signals of the speaker apparatus 10 is processed using a beamforming method based on Digital Signal Processing (DSP), so as to make acoustic energy radiation generated by the first plurality of speakers 11 greater in a first zone I than in a second zone II in a first frequency range.

In some embodiments, the beamforming method based on DSP may include a Delay and Sum beamforming method, or a sound pressure matching method.

In some embodiments, acoustic energy radiation generated by the second plurality of speakers is greater in a third zone III than in a fourth zone IV in a second frequency range. In some embodiment, the first frequency range overlaps with the second frequency range, so that the speaker apparatus 10 can overall generate acoustic energy radiation of strengthened directivity in a wideband range continuously.

In some embodiments, each first speaker 111 in the first plurality of speakers 11 may be a woofer, and each of the second plurality of speakers 12 may be a tweeter.

In some embodiments, it may be not necessary for a listener 13 in a front area of the speaker apparatus 10 to hear too much sound, but sounds at both sides of the listener 13 need to be strengthened, so as to improve the spacious effect and provide more real surround experience for the listener 13. Therefore, as shown in FIG. 1, in some embodiments, the first zone I may cover two side areas of the row of the first plurality of speakers 11, the second zone II may cover an area in front or back of the row of the first plurality of speakers 11, the third zone III may cover an area where openings of the second plurality of speakers 12 face, and the fourth zone IV may cover a side area of the second plurality of speakers 12.

In some embodiment, the acoustic energy radiation is usually characterized by sound pressure.

In some embodiment, the sound pressure produced by the first plurality of speakers 11 is greater in the first zone I than in the second zone II in a frequency range of 150 Hz to 3 kHz. That is, the first frequency range ranges from 150 Hz to 3 kHz. In some embodiment, the sound pressure produced by the second plurality of speakers 12 is greater in the third area III than in the fourth area IV in a frequency range of 2 kHz to 20 kHz. That is, the second frequency range ranges from 2 kHz to 20 kHz.

Figure 2:
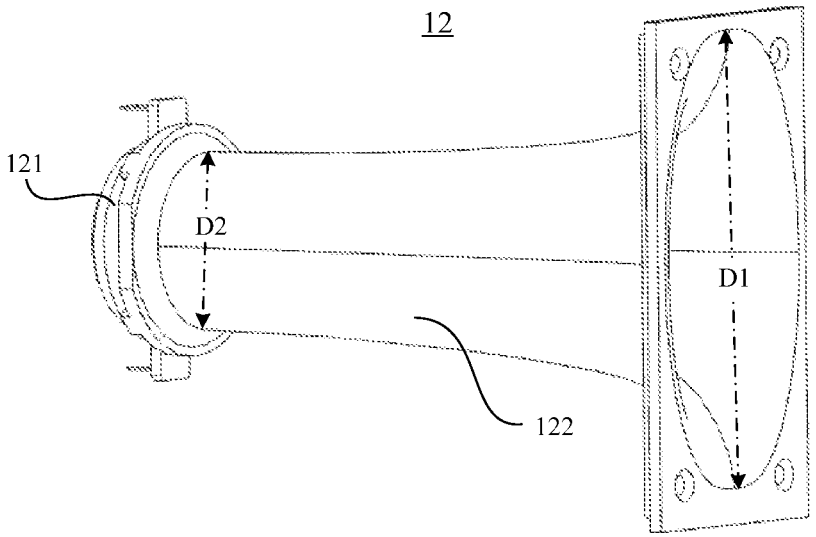
FIG. 2 schematically illustrates a stereogram of a horn speaker 12 according to an embodiment.

Referring to FIG. 2, FIG. 2 schematically illustrates a stereogram of a horn speaker 12 according to an embodiment. In some embodiments, each of the second plurality of speakers 12 includes a tweeter 121 and a horn 122 connected with the tweeter 121, where the horn 122 includes an input opening connected with the tweeter 121, and an output opening facing outwardly. Specifically, as shown in FIG. 1, opening of the horn 122 on the right side of the listener 13 may face x direction shown in FIG. 1, and opening of the horn 122 on the left side of the listener 13 may face −x direction.

In some embodiment, a ratio of a size of the output opening of the horn 122 to a size of the input opening of the horn 122, namely D1/D2 as shown in FIG. 2, is greater than two.

In some embodiments, a length of the horn 122 is greater than half of the interval between adjacent first speakers 111 in the row of the first plurality of speakers 11. In some embodiments, a length of the horn 122 may range from 2 cm to 16 cm.

In some embodiments, an angle between an opening of each horn 122 and an opening of each first speaker 111 may be 90°. In other embodiment, the angle between the opening of each horn 122 and the opening of each first speaker 111 may be greater than 70° and less than 90°, which can also strengthen the sideward acoustic energy radiation of the speaker apparatus 10 physically.

In other embodiments, the speaker apparatus may include more than two horn speakers. For example, the speaker apparatus may include four horn speakers, and two horn speakers are disposed on each side of the first plurality of speakers, so as to enhance the sideward acoustic energy radiation of the speaker apparatus.

It should be noted that, a first ratio of the sideward sound pressure to the forward sound pressure is also related to a second ratio of size of an opening at an output terminal of the horn 122 to size of an opening at an input terminal of the horn 122, namely D1/D2. The larger the second ratio, the greater the first ratio. In some embodiments, the second ratio is greater than two, for example five.

In some embodiments, the first plurality of speakers 11 may be disposed facing a front of the listener 13. In other embodiments, the first plurality of speakers may be disposed facing other directions, for example, facing one side direction of the listener, where the one side direction may be a right side direction (x direction shown in FIG. 1) or a left side direction (−x direction shown in FIG. 1) of the listener. In other embodiments, the first plurality of speakers may be disposed facing different directions, for example, some first speakers face a front of the listener, and other first speakers face a side direction of the listener.

In some embodiment, in order to achieve the acoustic energy radiation of strengthened directivity in a wideband range, a beamforming method based on DSP and an improved side firing method that take effect in different dominant frequency ranges may be combined. Specifically, the beamforming method based on DSP may be applied to process input signals of the first plurality of speakers 11, to achieve the acoustic energy radiation of strengthened directivity in the first frequency range; and the improved side firing method may be applied to the two second speakers 12, to achieve acoustic energy radiation of strengthened directivity in the second frequency range.

Firstly, with regard to the first plurality of speakers 11, it will be appreciated that, different beamforming methods based on DSP, for example a Delay and Sum beamforming method or a sound pressure matching method, can be applied to process the input signals of the first plurality of speakers 11, only if the beamforming methods based on DSP can enhance acoustic energy radiation of the first plurality of speakers 11 in a desired region, and constrain acoustic energy radiation of the first plurality of speakers 11 in an undesired region. The specific algorithm of different beamforming methods based on DSP will not be discussed in detail herein.

Figure 3:
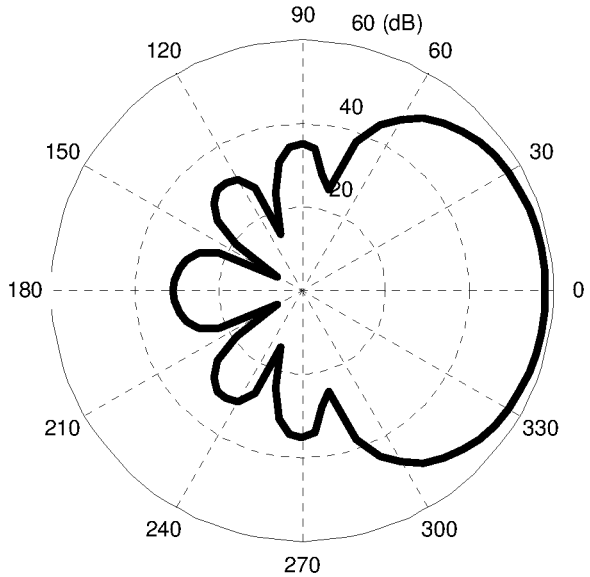
FIG. 3 schematically illustrates an exemplary directivity pattern of acoustic energy radiation of a first group of speakers 11*a* shown in FIG. 1 obtained at 1 kHz by simulation according to an embodiment.
Figure 4:
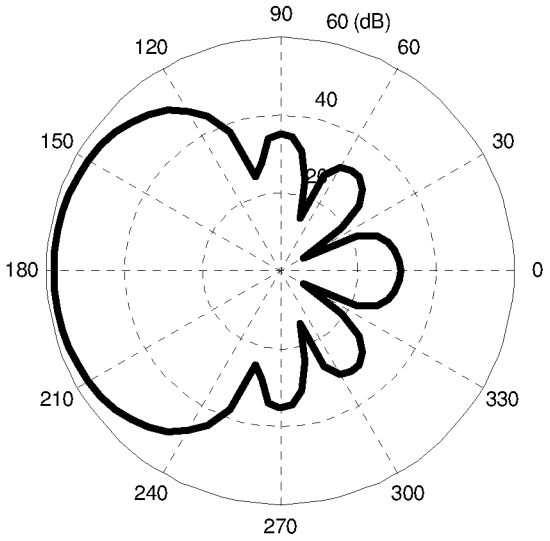
FIG. 4 schematically illustrates an exemplary directivity pattern of acoustic energy radiation of a second group of speakers 11*b* shown in FIG. 1 obtained at 1 kHz by simulation according to another embodiment.

Referring to FIG. 3 and FIG. 4, FIG. 3 schematically illustrates an exemplary directivity pattern of acoustic energy radiation of the first group of speakers 11*a* shown in FIG. 1 obtained at 1 kHz according to an embodiment, FIG. 4 schematically illustrates an exemplary directivity pattern of acoustic energy radiation of a second group of speakers 11*b* shown in FIG. 1 obtained at 1 kHz according to an embodiment, and both the directivity patterns of acoustic energy radiation in FIG. 3 and FIG. 4 are simulated using a beamforming method based on DSP.

It is clear that, a mainlobe (i.e. acoustic energy radiation in a fifth zone from 0° to 60° and from 300° to 360°(0°)) level is much larger than a sidelobe (i.e. acoustic energy radiation in a sixth zone from 60° to 300°) level. That is, acoustic energy radiation in one side area (0° to 60° and 300° to 360°(0°)) of the first plurality of speakers 11 can be strengthened by the first group of speakers 11*a*, while acoustic energy radiation in the front area, the back area and the other side area of the first group of speakers 11*a* are well constrained. In FIG. 4, acoustic energy radiation in a seventh zone ranging from 120° to 240° with respect to a center of the second group of speakers 11*b* is greatly enhanced, while acoustic energy radiation in an eighth area ranging from 0° to 120° and 240° to 360°(0°) with respect to the center of the second group of speakers 11*b* are well constrained. Therefore, the acoustic energy radiation in the other side area of the first plurality of speakers 11 can be strengthened by the second group of speakers 11*b*.

From FIG. 3 and FIG. 4, it can be seen that, acoustic energy radiation on both side areas of the speaker array 11 can be enhanced. In other embodiments, a mirror symmetry operation may be performed to the beamforming method based on DSP instead of being performed to positions of the first group of speakers 11*a*, which can also strengthen the acoustic energy radiation in both side areas of the first plurality of speakers 11.

Independently of the combination, it is difficult for the beamforming technology to achieve good performance in a wideband range, at least when compared to the combination.

This is especially true in a high frequency range. Factors that contribute to this include limited scale of the speaker array, size of the speaker, or robustness of the speaker system. Similarly, independently of the combination, it is difficult for side firing technology to achieve good performance in a wideband range, at least when compared to the combination. In general, side firing technology performs better in a high frequency range, while it makes little difference in a low frequency range. Factors that contribute to this are shape and size of the speaker. However, through the combination of the beamforming method and the side firing method, the speaker system achieves good performance over the wideband range. As an example, via the combination, the directivity is strengthened over the wideband range.

Theoretically, an upper frequency limit and a lower frequency limit of the first plurality of speakers 11 that can build effective beamformers as shown in FIG. 3 or FIG. 4, are related to the interval between adjacent first speakers 111 in the first plurality of speakers 11, and length of the first plurality of speakers 11. Specifically, an upper frequency limit of the first group of speakers 11*a* or the second group of speakers 11*b* can be derived from the anti-aliasing condition as described in equation (1):

$$f_a \leq \frac{c}{2\Delta x}, \tag{1}$$

where c is sound speed and Δx is the interval between the adjacent first speakers 111 in the first group of speakers 11*a* or in the second group of speakers 11*b*. In some embodiments, interval between the adjacent first speakers 111 in the first group of speakers 11*a* is equal to interval between the adjacent first speakers 111 in the second group of speakers 11*b*. From equation (1) it can be concluded that, the smaller the interval Δx is, the higher the upper frequency limit $f_{ua}$ will be. However, due to a limited scale of the first speaker 111, the upper frequency limit $$f_{ua} = \frac{c}{2\Delta x}$$

cannot be very high.

As for the lower frequency limit, its corresponding one-fourth wavelength should be smaller than or equal to the length of a first plurality of speakers $$\left(\text{i.e. } \frac{\lambda_a}{4} \leq L_a\right),$$

and the condition can be written as equation (2):

$$f_a \geq \frac{c}{4L_a}, \tag{2}$$

where $L_a$ is a length of the row of the first group of speakers 11*a* or a length of the row of the second group of speakers 11*b* in the first plurality of speakers 11. In some embodiments, the first group of speakers 11*a* and the second group of speakers 11*b* are configured with a same length. Therefore, if the lower frequency limit $$f_{la} = \frac{c}{4L_a}$$

needs to be small, the length $L_a$ of the first group of speakers 11*a* or the second group of speakers 11*b* in the first plurality of speakers 11 should be very large.

Figure 5:
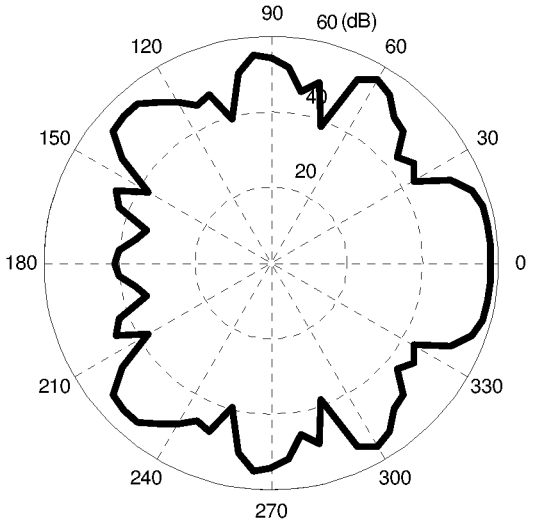
FIG. 5 schematically illustrates an example of an undesired directivity pattern of acoustic energy radiation of the first group of speakers 11*a* obtained at 6 kHz by simulation according to an embodiment.

From above, it is clear that, the first plurality of speakers 11 cannot achieve good performance in a full-band range, but be limited to a lower frequency range from $f_{la}$ to $f_{ua}$. Referring to FIG. 5, FIG. 5 schematically illustrates an example of an undesired directivity pattern of acoustic energy radiation of the first group of speakers 11*a* at 6 kHz, which is simulated using a beamforming method based on DSP. It is clear that, at the frequency higher than the upper frequency limit $f_{ua}$, the first group of speakers 11*a* presents an undesired directivity pattern, which is a lot different from the target directivity patterns as shown in FIGS. 2 and 3, and has some spatial coloration problem. This is the reason why the sound bars in the conventional technology show limited spacious effect.

In some embodiments, both the length of the first group of speakers 11*a* and the length of the second group of speakers 11*b* in the first plurality of speakers 11 may be about 400 mm, and the first group of speakers 11*a* and the second group of speakers 11*b* include five first speakers 111 respectively. Hence, the interval between the adjacent first speakers 111 in the first group of speakers 11*a* and the interval between the adjacent first speakers 111 in the second group of speakers 11*b* may be chosen to be 70 mm. According to the equations (1) and (2), the upper frequency limit of the first plurality of speakers 11 is about 2.5 kHz, and the lower frequency limit of the first plurality of speakers 11 is about 210 Hz.

Figure 6A:
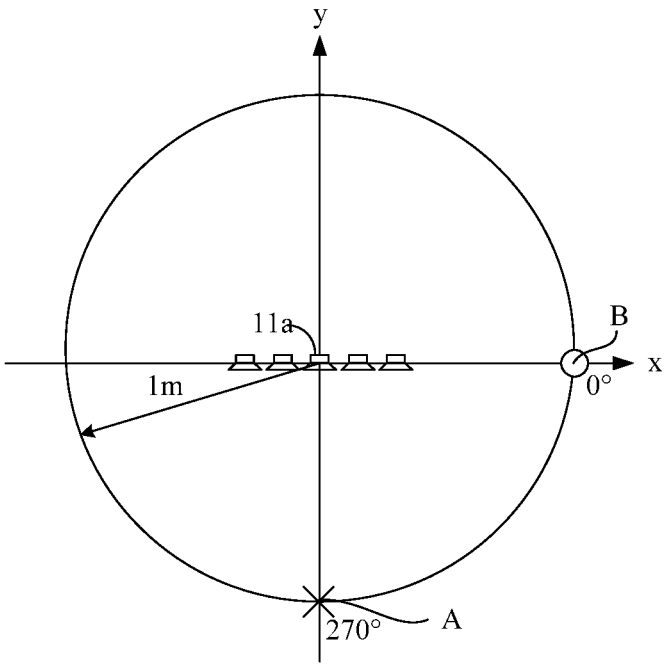
FIG. 6A schematically illustrates a front position A and a side position B of the first group of speakers 11*a* shown in FIG. 1.
Figure 6B:
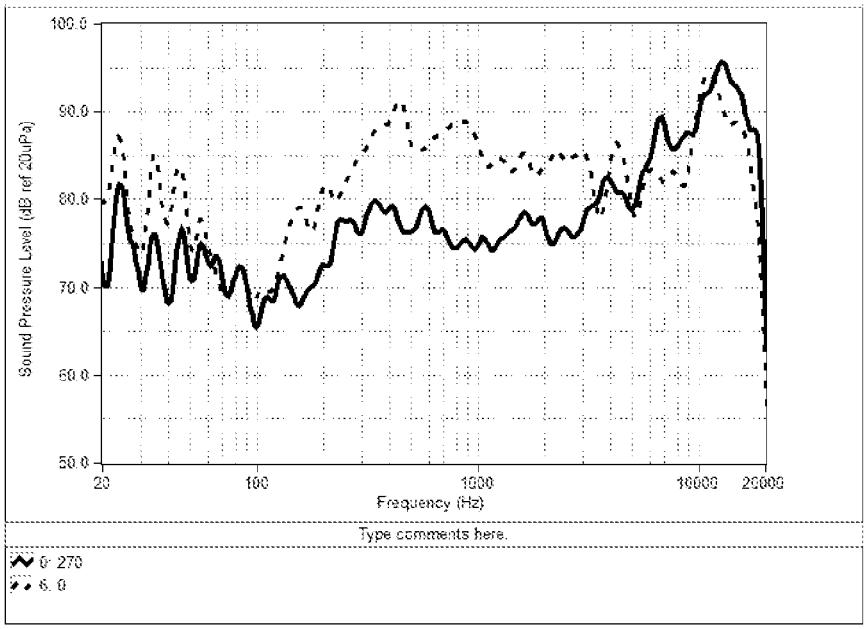
FIG. 6B schematically illustrates frequency responses of the first group of speakers 11*a* measured at the front position C and at the side position B shown in FIG. 6A.

Referring to FIG. 6A and FIG. 6B, FIG. 6A schematically illustrates a front position A and a side position B of the first group of speakers 11*a* in the first plurality of speakers 11 shown in FIG. 1. The front position A represented by 'X' and the side position B represented by 'O' are located on a circle with a radius of 1 m with respect to the center of the first group of speakers 11*a*, where the front position A is located at a 270° direction, that is, in a front direction of the row of the first group of speakers 11*a*, and the side position B is located at a 0° direction, namely in a side direction of the row of the first group of speakers 11*a*. FIG. 6B schematically illustrates frequency responses of the first group of speakers 11*a* at the front position A and at the side position B shown in FIG. 6A, where the dotted line represents frequency response of the first group of speakers 11*a* at the side position B, and the solid line represents frequency response of the first group of speakers 11*a* at the front position A.

In some embodiment, acoustic energy radiation of the first group of speakers 11*a* may be represented by sound pressure of the first group of speakers 11*a*, and sound pressure levels of the first group of speakers 11*a* at the side position B and at the front position A are practically measured.

In some embodiments, a criterion for determining acoustic energy radiation of the first plurality of speakers 11 being sideward directional in a frequency range may be that, sound pressure of the first plurality of speakers 11 at a side position is greater than sound pressure of the first plurality of speakers 11 at a front position in the frequency range.

As can be seen from FIG. 6B, sound pressure of the first group of speakers 11*a* at the side position B is greater than sound pressure of the first group of speakers 11*a* the front position A in a frequency range of about 150 Hz to 3 kHz, therefore beamformer of the first group of speakers 11*a* is sideward directional from about 150 Hz to 3 kHz. Specifically, a ratio of the sound pressure of the first group of speakers 11*a* at the side position B to the sound pressure of the first group of speakers 11*a* at the front position A is greater than 10 dB in more than 90 percent of the frequency range of about 150 Hz to 3 kHz. However, beamformer of the first group of speakers 11*a* cannot achieve such a directional effect outside this frequency range.

It should be noted that, frequency responses of the first group of speakers 11*a* at the side position B in 0° direction and at the front position A in 270° direction are shown in FIG. 6B to demonstrate the sideward directional beamformer of the first group of speakers 11*a*, because difference between the sound pressure in 0° direction and the sound pressure in 270° direction are relatively larger (referring to FIG. 3). While in side positions of other directions and in front positions of other directions, the above criterion for determining acoustic energy radiation of the first plurality of speakers 11 being sideward directional can also be satisfied, but differences between sound pressures at side positions of other directions and sound pressures at front positions of other directions may become smaller. Referring to FIG. 3, the sound pressure reaches a maximum value at 0°, and when a measured side position moves away from 0° clockwise or anticlockwise, the sound pressure at the measured side position may decrease, therefore the sound pressure difference between the side position and a front position may decrease gradually.

It should also be noted that, FIG. 6B shows the frequency responses of the first group of speakers 11*a*, while frequency responses of the second group of speakers 11*b* can be derived accordingly, which will not be discussed in detail herein. In some embodiments, a ratio of the sound pressure of the second group of speakers 11*b* at a side position in the 180° direction to the sound pressure of the second group of speakers 11*b* at the front position in the 270° direction is greater than 10 dB in more than 90 percent of a frequency range of about 150 Hz to 3 kHz, where the side position and the front position have a same distance from the center of the second group of speakers 11*b*.

As a result, sound pressure of the first plurality of speakers 11 in both side areas (i.e. the first zone I) of the first plurality of speakers 11 is greater than sound pressure of the first plurality of speakers 11 in the front area (the second zone II) of the first plurality of speakers 11 in the frequency range of about 150 Hz to 3 kHz. In some embodiments, the side areas may range from 0° to 60°, 300° to 0° and 120° to 240° with respect to the center of the first plurality of speakers 11, and the front area may range from 240° to 300° with respect to the center of the first plurality of speakers 11. Especially, a ratio of sound pressure of the first plurality of speakers 11 at a side position (0° or 180°) to sound pressure of the first plurality of speakers 11 at a front position (270°) may be greater than 10 dB in more than 90 percent of the frequency range of about 150 Hz to 3 kHz.

From above, it is clear that, the first group of speakers 11*a* of the left channel can generate acoustic energy radiation that is strengthened in one side area of the speaker apparatus 10, and the second group of speakers 11*b* of the right channel can generate acoustic energy radiation that is strengthened in the other side area of the speaker apparatus 10, so that acoustic energy radiation of the first plurality of speakers 11 can be strengthened on both side areas of the speaker apparatus 10.

Secondly, in a second frequency range, namely, the high frequency range, an improved side firing method is applied in some embodiments to achieve the acoustic energy radiation of strengthened directivity of the second plurality of speakers 12.

Normally, in the side firing method, a side firing speaker is disposed, that is, a speaker is disposed with opening facing a side direction of a listener, so as to strengthen the sideward directivity while limit the forward directivity physically. In some embodiments, the side firing speaker may be a tweeter. In order to research frequency response of the tweeter at different directions, sound pressures at different directions of the tweeter may be measured.

Figure 7A:
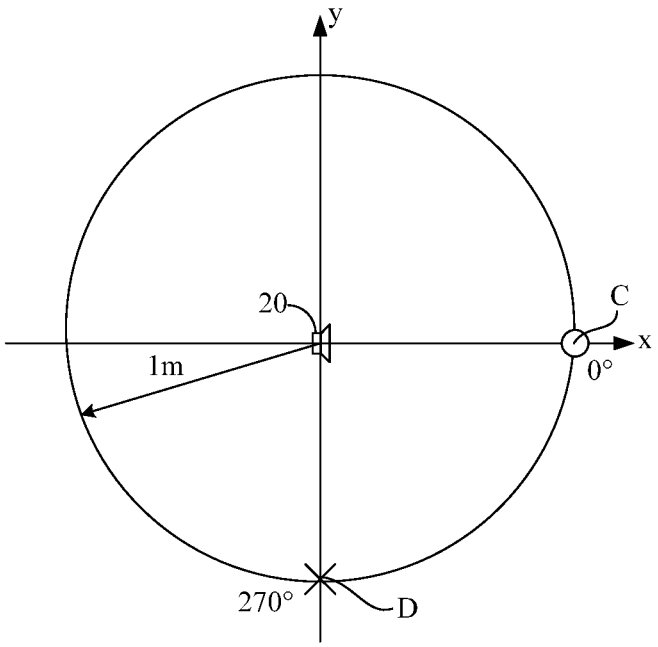
FIG. 7A schematically illustrates a front position C and a side position D of a tweeter 20.
Figure 7B:
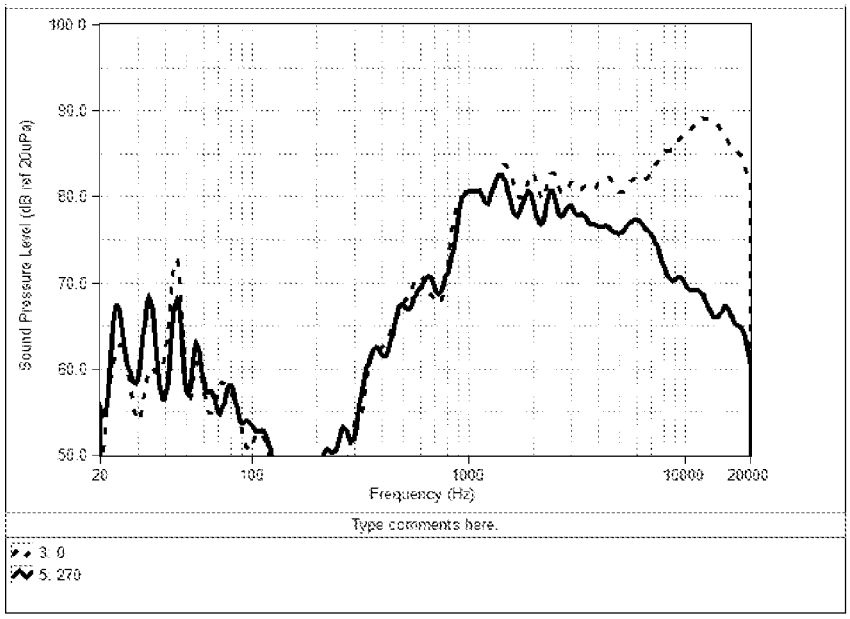
FIG. 7B schematically illustrates frequency responses of the tweeter 20 measured at the front position C and at the side position D shown in FIG. 7A.

Referring to FIG. 7A in conjunction with FIG. 7B, FIG. 7A schematically illustrates a front position C and a side position D of a tweeter 20, where the front position C represented by 'O' is located in a 0° direction with respect to a center of the tweeter 20 in which an opening of the tweeter 20 faces, and the side position D represented by 'X' is located in a 270° direction with respect to the center of the tweeter 20. FIG. 7B schematically illustrates frequency responses of the tweeter 20 at the side position D and at the front position C shown in FIG. 7A, where the dotted line represents frequency response of the tweeter 20 at the front position C, and the solid line represents frequency response of the tweeter 20 at the side position D.

In some embodiments, acoustic energy radiation of the tweeter 20 may be characterized by sound pressure of the tweeter 20, and a sound pressure level of the tweeter 20 at the side position D and a sound pressure level of the tweeter 20 at the front position C are practically measured.

From FIG. 7B, it is clear that, the directivity pattern of the tweeter 20 is sharp only in a very high frequency range, for example, from 8 kHz to 20 kHz. In order to enhance the sound pressure and achieve a sharp directivity pattern in both a middle frequency range and a high frequency range, an improved side firing method is proposed by the inventors, which includes configuring the speaker apparatus 10 with two improved side firing speakers. In some embodiments, the two improved side firing speakers may be two horn speakers 12 as shown in FIG. 1 and FIG. 2.

Similar to the lower frequency limit of the first plurality of speakers 11 as described above, a lower frequency limit of the horn speaker 12 is also related to length of the horn 122, and frequency of the horn speaker 12 can be derived from the equation (3):

$$f_h \geq \frac{c}{4L_h}, \tag{3}$$

where $L_h$ is length of the horn 122. Therefore, a frequency $$f_{lh} = \frac{c}{4L_h}$$

can be regarded as the lower frequency limit of the horn speaker 12. Specifically, the length of the horn 122 may refer to a vertical distance between the input opening of the horn 122 and the output opening of the horn 122.

A crossover frequency between the first plurality of speakers 11 and the horn speaker 12 should be larger than $f_{lh}$ but smaller than $f_{ua}$, in order to ensure the speaker apparatus 10 can produce a sharp directivity pattern in both high and low frequency range. Therefore, the upper frequency limit of the first plurality of speakers 11 and the lower frequency limit of the horn speaker 12 should satisfy $f_{ua} \geq f_{lh}$, then we have equation (4):

$$2L_h \geq \Delta x \quad (4).$$

To ensure this condition in engineering, we will have $L_h \approx \Delta x$. Therefore, in some embodiments, the length $L_h$ of the horn 122 is designed to be approximatively equal to the interval Δx between adjacent first speakers 111 in the first plurality of speakers 11.

In some embodiment, the interval Δx between adjacent first speakers 111 in the first plurality of speakers 11 may be 50 mm, and length $L_h$ of the horn 122 may be 50 mm as well, thus the lower frequency limit $f_{lh}$ of the horn speaker 12 is 1.7 kHz.

Figure 8A:
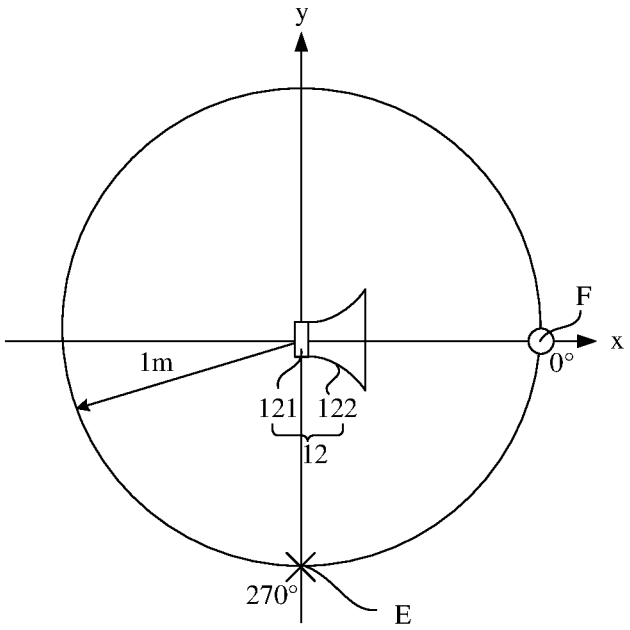
FIG. 8A schematically illustrates a front position E and a side position F of the right horn speaker 12.
Figure 8B:
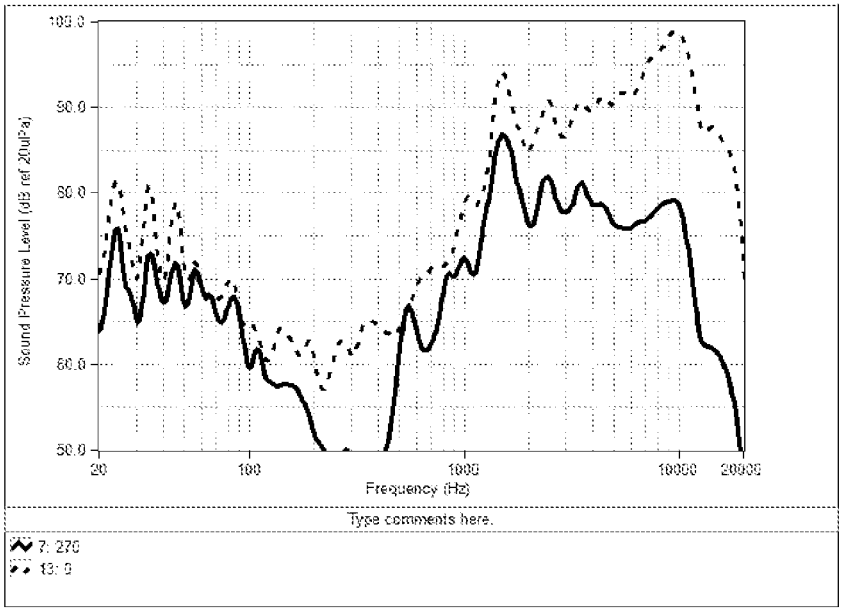
FIG. 8B schematically illustrates frequency responses of the right horn speaker 12 measured at the front position E and at the side position F shown in FIG. 8A.

With continued reference to FIG. 8A and FIG. 8B, FIG. 8A schematically illustrates a side position E and a front position F of the right horn speaker 12 which is located at the right side of the listener 13 shown in FIG. 1. The side position E represented by 'X' and a front position F represented by 'O' are located at a circle with a radius of 1 m with respect to the center of the tweeter 121 of the right horn speaker 12, where the side position E is located at a 270° direction, and the front position F is located at a 0° direction in which the opening of the right horn speaker 12 faces. FIG. 8B schematically illustrates frequency responses of the right horn speaker 12 at the side position E and at the front position F shown in FIG. 8A, where the dotted line represents frequency response of the right horn speaker 12 at the front position F, and the solid line represents frequency response of the right horn speaker 12 at the side position E.

In some embodiment, the acoustic energy radiation of the right horn speaker 12 may be characterized by sound pressure of the right horn speaker 12, and the sound pressure levels of the right horn speaker 12 at the front position F and at the side position E are practically measured.

In some embodiments, a criterion for determining acoustic energy radiation of the right horn speaker 12 being sideward directional in a frequency range may be that, sound pressure of the horn speaker 12 at a side position is greater than sound pressure of the horn speaker 12 at a front position in the frequency range.

As can be seen from FIG. 8B, sound pressure of the right horn speaker 12 at the front position F is greater than sound pressure of the right horn speaker 12 at the side position E in a frequency range of about 2 kHz to 20 kHz, therefore acoustic energy radiation of the horn speaker 12 is sideward directional from about 2 kHz to 20 kHz. Specifically, a ratio of the sound pressure of the right horn speaker 12 at the front position F to the sound pressure of the right horn speaker 12 at the side position E is greater than 10 dB in more than 90 percent of the frequency range of about 2 kHz to 20 kHz.

It should be noted that, frequency responses of the right horn speaker 12 at the side position E and at the front position F are shown in FIG. 8B to demonstrate acoustic energy radiation of the right horn speaker 12 is sideward directional, because difference between the sound pressure in 0° direction and the sound pressure in 270° direction are relatively larger. While in side positions of other directions and front positions of other directions, acoustic energy radiation of the right horn speaker 12 also satisfy the criterion for determining acoustic energy radiation of the right horn speaker 12 being sideward directional as described above, but differences between sound pressures at side positions of other directions and sound pressures at front positions of other directions may be less than the difference between the sound pressures at 0° and 270°, which can refer to the corresponding description on the first plurality of speakers 11, and thus will not be described in detail herein.

Referring to FIG. 1, in some embodiments, sound pressure of the right horn speaker 12 in a third zone III is greater than sound pressure of the horn speaker 12 in a fourth zone IV in a frequency range of about 2 kHz to 20 kHz, where the third zone III covers an area where the opening of the right second speaker 12 faces, and the fourth zone IV covers a side area of the right second speaker 12. Specifically, the third area III may range from 0° to 60° and 300° to 0° with respect to the center of the right horn speaker 12, and the fourth area IV may range from 240° to 300° with respect to the center of the right horn speaker 12.

It should be noted that, FIG. 8B shows the frequency responses of the right horn speaker 12, while frequency responses of the left horn speaker 12 can be derived accordingly, which will not be discussed in detail herein. In some embodiments, sound pressure of the left horn speaker 12 in a third zone III is greater than sound pressure of the left horn speaker 12 in a fourth zone IV in the frequency range of about 2 kHz to 20 kHz, where the third zone III covers an area where the opening of the left second speaker 12 faces, and the fourth zone IV covers a side area of the left second speaker 12. In some embodiments, acoustic radiation on two side areas of each horn speaker 12 are symmetrical, therefore, acoustic radiation on two side areas of the horn speaker 12 can be constrained, while acoustic radiation in front of the horn speaker 12 can be strengthened.

Using the improved side firing method, the second frequency range where the two horn speakers 12 can achieve acoustic energy radiation of strengthened directivity is expanded when the length and the opening of the horn 122 are both large, that is, the second frequency range actually covers both a middle frequency range and a high frequency range.

Hence, we can combine the beamforming method based on DSP and the improved side firing method together and choose a crossover frequency between a low frequency limit of the horn speakers 12 (for example, 2 kHz) and a high frequency limit of the first plurality of speakers 11 (for example, 3 kHz).

In some embodiments, a crossover frequency of 2.4 kHz is chosen. Then sound pressure of the speaker apparatus 10 in both side areas of the speaker apparatus 10 is greater than sound pressure of the speaker apparatus 10 in the front area of the speaker apparatus 10 where a listener 13 is located in the frequency range of about 150 Hz to 20 kHz. In some embodiments, the side areas may range from 0° to 60°, 300° to 0° and 120° to 240° with respect to the center of the speaker apparatus 10, and the front area may range from 240° to 300° with respect to the center of the speaker apparatus 10. Especially, a ratio of sound pressure of the speaker apparatus 10 at a side position in 0° or 180° direction with respect to a center of the speaker apparatus 10 to sound pressure of the speaker apparatus 10 at a front position in 270° direction with respect to the center of the speaker apparatus 10 may be greater than 10 dB in more than 90 percent of the frequency range of about 150 Hz to 20 kHz, where the side position and the front position have a same distance from the center of the speaker apparatus 10.

In some embodiments, the interval between adjacent first speakers 111 in the first plurality of speakers 11, and the length of the horn 12 may be set as 10 cm and 12 cm respectively, an upper frequency limit $f_{ua}$ of the first plurality of speakers 11 is 1.7 kHz and a lower frequency limit $f_{lh}$ of the horn speaker 12 is 700 Hz, then the crossover frequency may be chosen as 1.5 kHz. The number of the first speakers 111 in the first plurality of speakers 11 should be at least three to extend the low frequency range. The second ratio of size of an opening at an output terminal of the horn 122 to size of an opening at an input terminal of the horn 122 is chosen to be about 5.

In order to achieve that the speaker apparatus 10 can produce acoustic energy radiation of strengthened directivity in a wideband range, there are various parameter designs of the first plurality of speakers 11 and the horn speaker 12. In some embodiments, the interval between adjacent first speakers 111 in the first plurality of speakers 11 may range from 2 cm to 16 cm, the length of the horn 122 may range from 2 cm to 16 cm, and length of the first plurality of speakers 11 may range from 20 cm to 2 m. In some embodiments, the speaker apparatus 10 may produce the acoustic energy radiation of strengthened directivity in a wide frequency range of 40 Hz to 20 kHz. In some embodiments, the first plurality of speakers 11 may produce the acoustic energy radiation of strengthened directivity in a frequency range of 40 Hz to 8 kHz, and the two horn speakers 12 may produce the acoustic energy radiation of strengthened directivity in a frequency range of 800 Hz to 20 kHz.

The acoustic energy radiation of strengthened directivity of the first plurality of speakers 11 in some embodiments may be achieved by software (i.e. a beamforming method based on DSP), while the acoustic energy radiation of strengthened directivity of the two second speakers 12 may be achieved by hardware (i.e., an improved side firing speaker including a tweeter and a horn), the first plurality of speakers 11 are configured to operate in a first frequency range (i.e. a low frequency range), the two second speakers 12 are configured to operate in a second frequency range (a middle and high frequency range), and the first frequency range overlaps with the second frequency range. Therefore, the speaker apparatus 10 in the some embodiments can overall produce acoustic energy radiation of strengthened directivity in a wideband frequency range, so as to present a near-real surround experience to the listener 13.

A method for processing input audio signals of the speaker apparatus 10 as described above is also provided according to embodiments.

Figure 9:
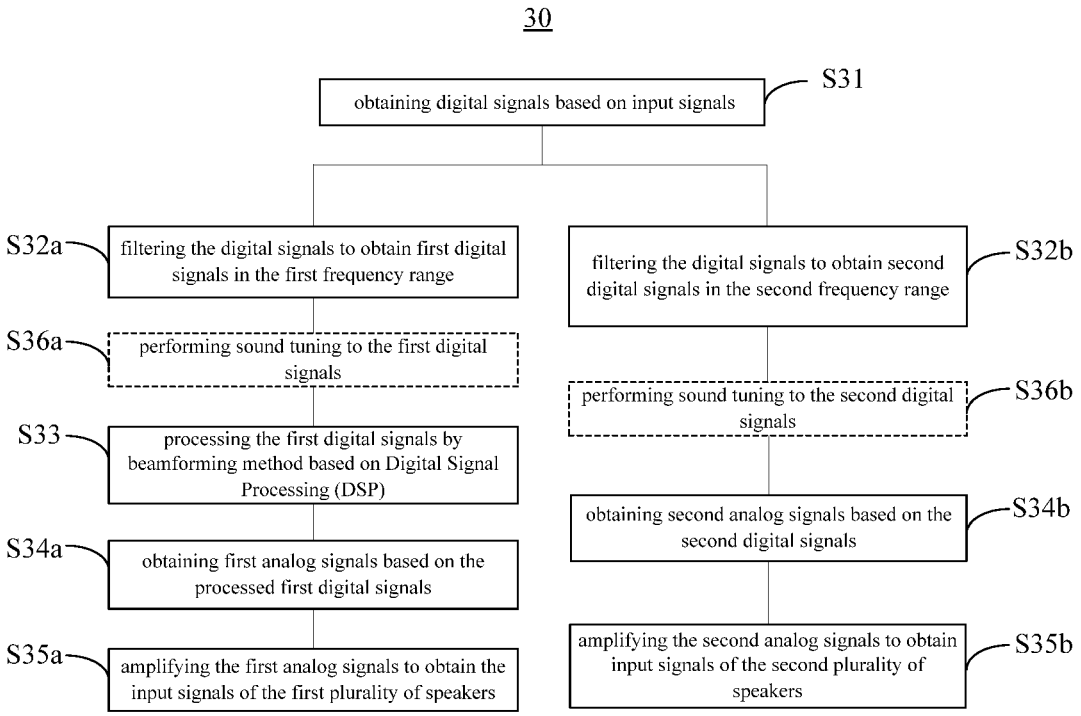
FIG. 9 schematically illustrates a flow chart of a method 30 for processing input signals of the speaker apparatus 10 shown in FIG. 1 according to an embodiment.

Referring to FIG. 9, FIG. 9 schematically illustrates a flow chart of a method 30 for processing input audio signals of the speaker apparatus 10 shown in FIG. 1 according to an embodiment. The speaker apparatus 10 includes a first plurality of speakers 11 arranged at an interval in a row and a second plurality of speakers 12 symmetrically disposed at two sides of the row of the first plurality of speakers with openings at the two sides facing outwardly, where acoustic energy radiation of the first plurality of speakers 11 is greater in a first zone I than in a second zone II in a first frequency range, acoustic energy radiation of the second plurality of speakers 12 is greater in a third zone III than in a fourth zone IV in a second frequency range, and the first frequency range overlaps with the second frequency range. The method 30 may include the following steps.

In S31, digital signals are obtained based on input signals. In some embodiments, the input signals may be stereo or multi-channel audio signals, and decoding or an analog-digital (A/D) conversion may be performed to the input signals to obtain the digital signals. If the input signals are digital signals, then the input signals are decoded; if the input signals are analog signals, then the A/D conversion are performed to the input signals.

In S32*a* and S32*b*, the digital signals are filtered to obtain first digital signals in the first frequency range and second digital signals in the second frequency range. In some embodiment, the digital signals are filtered by a first filter in S32*a* to obtain the first digital signals, and the digital signals are also filtered by a second filter in S32*b* to obtain the second digital signals, where the first filter and the second filter have a crossover frequency. Specifically, the first filter may be a low pass filter and the second filter may be a high pass filter.

In S33, the first digital signals are processed by a beamforming method based on Digital Signal Processing (DSP), to make the acoustic energy radiation generated by the first plurality of speakers 11 greater in the first zone I than in the second zone II, where the first zone I may cover a side area of the row of the first plurality of speakers 11, the second zone II may cover an area in front or back of the row of the first plurality of speakers 11, In some embodiments, the beamforming method based on DSP may include a Delay and Sum beamforming method, or a sound pressure matching method.

Referring to FIG. 2, FIG. 2 schematically illustrates an exemplary directivity pattern of acoustic energy radiation of the first group of speakers 11*a* in the first plurality of speakers 11 shown in FIG. 1 at 1 kHz, which is simulated using a beamforming method based on DSP. Herein, a center point of the first group of speakers 11*a* is defined as an origin, one side direction of the row of the first group of speakers 11*a* is defined as 0°, and a front direction of the row of the first group of speakers 11*a*, i.e. a direction in which the listener 13 is located with respect to a center of the first plurality of speakers 11 is defined as 270°. It is clear that, a mainlobe (i.e. acoustic energy radiation in a fifth zone from 0° to 60° and from 300° to 360°(0°)) level is much larger than a sidelobe (i.e. acoustic energy radiation in a sixth zone from 60° to 300°) level. That is, acoustic energy radiation in the one side area (0° to 60° and 300° to 360°(0°)) of the first group of speakers 11*a* can be greatly enhanced by processing input signals of the first group of speakers 11*a* using the beamforming method based on DSP.

In some embodiments, the first plurality of speakers 11 include a first group of speakers 11*a* and a second group of speakers 11*b*, the first group of speakers 11*a* may be applied as a left channel and a second group of speakers 11*b* may be applied as a right channel, and the first group of speakers 11*a* and the second group of speakers 11*b* are symmetrically disposed.

Referring to FIG. 3, FIG. 3 schematically illustrates an exemplary directivity pattern of acoustic energy radiation of the second group of speakers 11*b* shown in FIG. 1 at 1 kHz according to another embodiment, which is simulated using a beamforming method based on DSP. It is clear that, acoustic energy radiation in a seventh zone ranging from 120° to 240° with respect to a center of the second group of speakers 11*b* is greatly enhanced, while acoustic energy radiation in an eighth area ranging from 0° to 120° and 240° to 360°(0°)) with respect to the center of the second group of speakers 11*b* are well constrained. Therefore, by the acoustic energy radiation in the other side area of the first plurality of speakers 11 can be strengthened by processing input signals of the second group of speakers 11*b* using the beamforming method based on DSP.

From FIG. 2 and FIG. 3, it can be seen that, acoustic energy radiation on both side areas of the first plurality of speakers 11 can be enhanced. In other embodiments, a mirror symmetry operation may be performed to the beamforming method based on DSP instead of being performed to positions of the first group of speakers 11*a*, which can also strengthen the acoustic energy radiation in both side areas of the first plurality of speakers 11.

In S34*a* and S34*b*, first analog signals and second analog signals are obtained based on the processed first digital signals and the second digital signals. Specifically, a digital-analog (D/A) conversion may be performed to the first digital signals and the second digital signals respectively to obtain the first analog signals and the second analog signals respectively.

In S35*a* and S35*b*, the first analog signals and the second analog signals are respectively amplified, where the amplified first analog signals are adapted to be input to the first plurality of speakers 11 and the amplified second analog signals are adapted to be input to the second plurality of speakers 12.

In some embodiments, the method 30 may further include S36*a* between S32*a* and S33, and S36*b* between S32*b* and S34*b*. In S36*a* and S36*b*, sound tuning is performed to the first digital signals and the second digital signals respectively, so as to make audios of the speaker apparatus 10 sound more pleasant and closer to the audio source itself.

In other embodiment, the sound tuning step may be performed prior to S32*a* and S32*b*, that is, the sound tuning may be performed to the digital signals in full-band.

Figure 10:
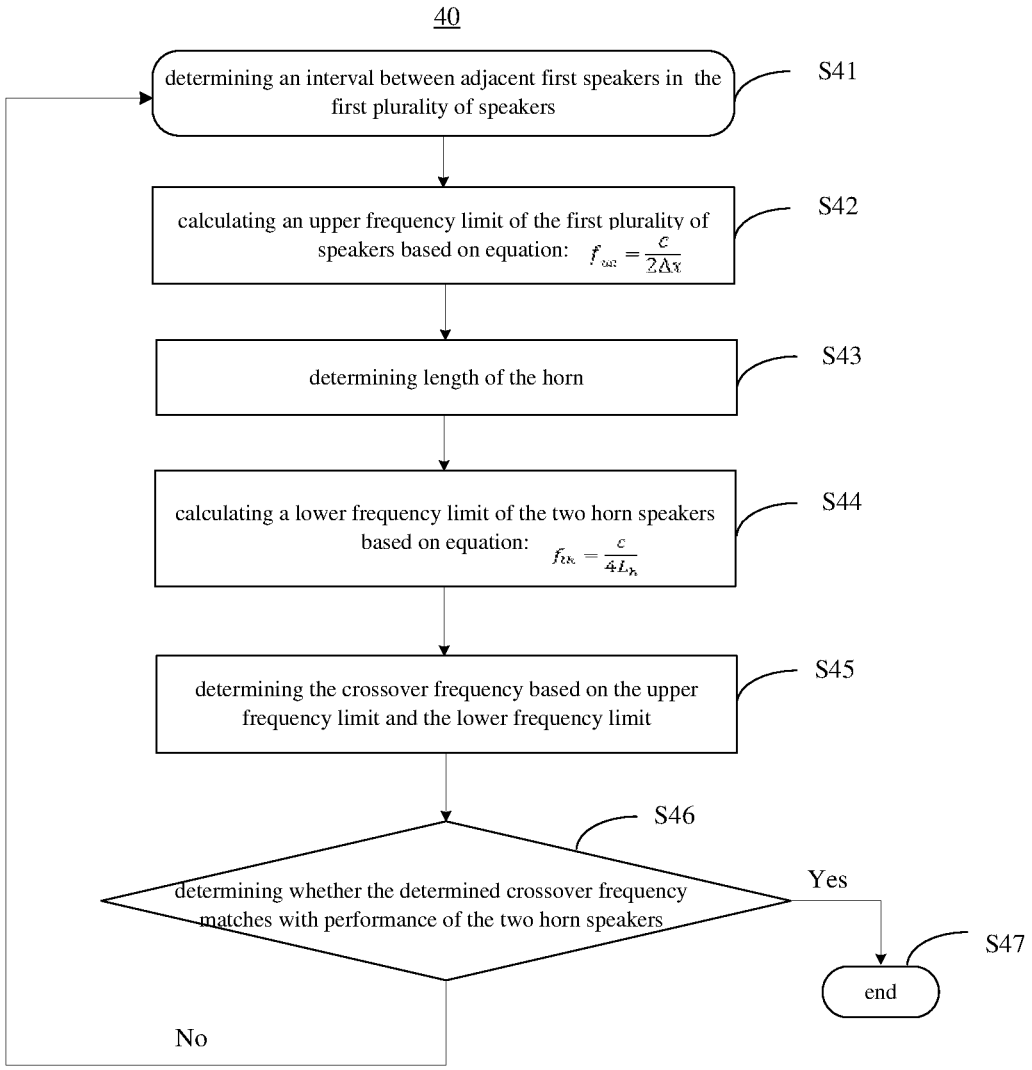
FIG. 10 schematically illustrates a flow chart of a method 40 for determining a crossover frequency between a first filter and a second filter applied in the method 30 according to an embodiment.

The first filter applied in S32*a* and the second filter applied in S32*b* have a crossover frequency, so that the first frequency range where the first plurality of speakers 11 operate can overlap with the second frequency range where the two second speakers 12 operate. Besides, the crossover frequency need to be carefully determined so that the speaker apparatus 10 can produce acoustic radiation of a desired directivity in a wide band range. Referring to FIG. 10, FIG. 10 schematically illustrates a flow chart of a method 40 for determining the crossover frequency according to an embodiment. In some embodiments, each of the second plurality of speakers includes a tweeter and a horn connected with the tweeter, the method 40 may include the following steps.

In S41, an interval Δx between adjacent first speakers 111 in the first plurality of speakers 11 is determined.

In S42, an upper frequency limit $f_{ua}$ of the first plurality of speakers 11 is calculated based on equation (5):

$$f_{ua} = \frac{c}{2\Delta x}, \tag{5}$$

where c is sound speed and Δx is the interval between the adjacent first speakers 111.

In S43, length of the horn 122 $L_h$ is determined. In some embodiments, when the upper frequency limit $f_{ua}$ of the first plurality of speakers 11 is obtained, a theoretical lower frequency limit the $f'_{lh}$ of the horn speaker 12 can be obtained, then the length of the horn 122 $L_h$ can be determined based on the theoretical lower frequency limit $f'_{lh}$. Specifically, the theoretical lower frequency limit $f'_{lh}$ of the horn speaker 12 may be less than the upper frequency limit $f_{ua}$ of the first plurality of speakers 11.

In S44, a lower frequency limit $f_{lh}$ of the two horn speakers 12 is calculated based on equation (6):

$$f_{lh} = \frac{c}{4L_h}, \tag{6}$$

where c is sound speed and $L_h$ is the length of the horn 122 that is determined in S43. It should be noted that, a lower frequency limit of the horn speaker 12 that is practically measured is usually slightly deviate from the calculated lower frequency limit $f_{lh}$ herein.

In S45, the crossover frequency is determined based on the upper frequency limit $f_{ua}$ and the lower frequency limit $f_{lh}$.

In some embodiments, the method may further include S46. In S46, whether the crossover frequency determined in S45 matches with performance of the second plurality of speakers 12, i.e. the two horn speakers 12 is determined. If not, such as the crossover frequency is too small and the tweeter 121 can not play normally, that means the above determined parameters in the method 40 are not appropriate, and then the method 40 is directed to S41, the interval Δx of the plurality of first speakers 111 in the first plurality of speakers 11 will be readjusted and steps of S41 to S46 of the method 40 will be repeated until an appropriate crossover frequency is determined in S46; if yes, the method 40 is directed to S47, that is, the method 40 is ended.

In some embodiment, the interval Δx between adjacent first speakers 111 in the first plurality of speakers 11, and the length $L_h$ of the horn 122 may be set as 10 cm and 12 cm respectively, then an upper frequency limit $f_{ua}$ of the first plurality of speakers 11 is 1.7 kHz and a lower frequency limit $f_{lh}$ of the horn speaker 12 is 700 Hz, and the crossover frequency may be chosen as 1.5 kHz.

In some embodiments, an upper frequency limit $f_{ua}$ of the first plurality of speakers 11 may be 8 kHz, and a lower frequency limit $f_{lh}$ of the horn speaker 12 may be 800 Hz to 20 kHz, then the crossover frequency of the low pass filter and the high pass filter may be chosen between 800 Hz to 5 kHz.

Figure 11:
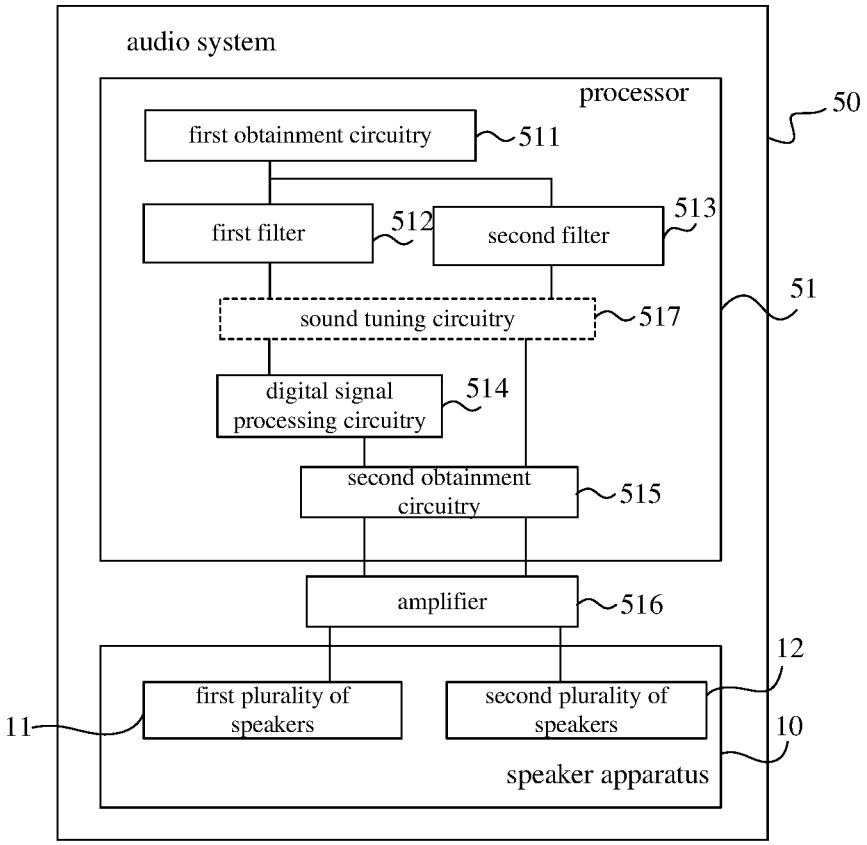
FIG. 11 schematically illustrates a block diagram of an audio system 50 according to an embodiment.

An audio system is also provided according to some embodiments. Referring to FIG. 11, FIG. 11 schematically illustrates an audio system 50 according to embodiments.

In some embodiments, the audio system 50 may include the aforementioned speaker apparatus 10 shown in FIG. 1 and a processor 51. As shown in FIG. 1, the speaker apparatus 10 may include a first plurality of speakers 11 arranged at an interval in a row, and a second plurality of speakers 12 symmetrically disposed at two sides of the row of the first plurality of speakers 11 with openings at the two sides facing outwardly, where acoustic energy radiation generate by the first plurality of speakers 11 is greater in a first zone I than in a second zone II in a first frequency range, acoustic energy radiation generate by the second plurality of speakers 12 is greater in a third zone III than in a fourth zone IV in a second frequency range, and the first frequency range overlaps with the second frequency range.

In some embodiments, the first zone I may cover a side area of the row of the first plurality of speakers 11, the second zone II may cover an area in front or back of the row of the first plurality of speakers 11, the third zone III may cover an area where the openings of the second plurality of speakers 12 face, and the fourth zone IV may cover a side area of the second plurality of speakers 12. Structures and functions of the speaker apparatus 10 may refer to the above descriptions, which will not be discussed in detail herein.

In some embodiments, the processor 51 may be configured to process input signals of the speaker apparatus 10. The processor 51 may include a first obtainment circuitry 511, a first filter 512, a second filter 513, and a digital signal processing circuitry 514.

The first obtainment circuitry 511 is configured to obtain digital signals based on the input signals. In some embodiment, the first obtainment circuitry 511 may be a decoder or an Analog-Digital Converter (ADC).

The first filter 512 is configured to filter the digital signals to obtain first digital signals in the first frequency range, and the second filter 513 is configured to filter the digital signals to obtain second digital signals in the second frequency range. In some embodiment, the first filter 512 may be a low pass filter, and the second filter 513 may be a high pass filter, where the low pass filter and the high pass filter has a crossover frequency.

The digital signal processing circuitry 514 is configured to process the first digital signals using a beamforming method based on Digital Signal Processing (DSP), to make the acoustic energy radiation generated by the first plurality of speakers 11 greater in the first zone I (shown in FIG. 1) than in the second zone II (shown in FIG. 1), where the processed first digital signals are adapted to be input to the first plurality of speakers 11, and the second digital signals are adapted to be input to the second plurality of speakers 12.

In some embodiment, the processor 51 may further include a second obtainment circuitry 515 and the audio system 50 may further include an amplifier 516.

The second obtainment circuitry 515 is configured to obtain first analog signals and second analog signals based on the processed first digital signals and the second digital signals. In some embodiments, the second obtainment circuitry 515 may be a Digital-Analog Converter (DAC).

The amplifier 516 is configured to amplify the first analog signals and the second analog signals, where the amplified first analog signals are adapted to be input to the first plurality of speakers 11 and the amplified second analog signals are adapted to be input to the second plurality of speakers 12.

In some embodiment, the processor 51 may further include a sound tuning circuitry 517, which is configured to perform sound tuning to the first digital signals before processing the first digital signals by the digital signal processing circuitry 514, and is configured to perform sound tuning to the second digital signals before obtaining the second analog signals by the second obtainment circuitry 515.

In some embodiment, a crossover frequency of the first filter 512 and the second filter 513 ranges from 800 Hz to 5 kHz. The method for determining the crossover frequency of the first filter 512 and the second filter 513 may refer to the above description on method 40 in FIG. 10, which will not be discussed in detail herein.

An embodiment may optimize the length of the first plurality of speakers 11, the interval between the adjacent first speakers 111, and the length and the openings of the horn 122 that can improve the side firing speakers, and the crossover frequency of the first plurality of speakers 11 and the two horn speakers 12, so that the speaker apparatus 10 can generate acoustic energy radiation of strengthened directivity in a wide frequency range, and the sideward sound perceived by the listener 13 is larger than forward sound perceived by the listener 13. Therefore, the speaker apparatus, the method for processing input signals of the speaker apparatus, and the audio system can achieve a wide spacious effect and provide a near-real surround experience to listeners.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The invention claimed is:

1. A speaker apparatus, comprising:

a first plurality of speakers, arranged at an interval in a row, where acoustic energy radiation generated by the first plurality of speakers is greater in a first zone than in a second zone in a first frequency range; and a second plurality of speakers, symmetrically disposed at two sides of the row of the first plurality of speakers with openings at the two sides facing outwardly, where acoustic energy radiation generated by the second plurality of speakers is greater in a third zone than in a fourth zone in a second frequency range;

wherein the first frequency range overlaps with the second frequency range.

2. The speaker apparatus according to claim 1, wherein the first zone covers a side area of the row of the first plurality of speakers, the second zone covers an area in front or back of the row of the first plurality of speakers, the third zone covers an area where the openings of the second plurality of speakers face, and the fourth zone covers a side area of the second plurality of speakers.

3. The speaker apparatus according to claim 1, wherein sound pressure produced by the first plurality of speakers is greater in the first zone than in the second zone in a frequency range of 150 Hz to 3 kHz.

4. The speaker apparatus according to claim 1, wherein sound pressure produced by the second plurality of speakers is greater in the third area than in the fourth area in a frequency range of 2 kHz to 20 kHz.

5. The speaker apparatus according to claim 1, wherein each of the second plurality of speakers comprises a tweeter and a horn connected with the tweeter, and the horn comprises an input opening connected with the tweeter, and an output opening facing outwardly.

6. The speaker apparatus according to claim 5, wherein a ratio of a size of the output opening of the horn to a size of the input opening of the horn is greater than two.

7. The speaker apparatus according to claim 5, wherein a length of the horn is greater than half of the interval between adjacent speakers in the row of the first plurality of speakers.

8. The speaker apparatus according to claim 5, wherein the interval between adjacent speakers in the row of the first plurality of speakers ranges from 2 cm to 16 cm, and length of the horn ranges from 2 cm to 16 cm.

9. The speaker apparatus according to claim 1, wherein input signals of the first plurality of speakers are processed by a beamforming method based on Digital Signal Processing (DSP), so as to make the acoustic energy radiation generated by the first plurality of speakers greater in the first zone than in the second zone.

10. A method for processing input signals of a speaker apparatus, wherein the speaker apparatus comprises a first plurality of speakers arranged at an interval in a row and a second plurality of speakers symmetrically disposed at two sides of the row of the first plurality of speakers with openings at the two sides facing outwardly, acoustic energy radiation of the first plurality of speakers is greater in a first zone than in a second zone in a first frequency range, acoustic energy radiation of the second plurality of speakers is greater in a third zone than in a fourth zone in a second frequency range, and the first frequency range overlaps with the second frequency range, comprising:

obtaining digital signals based on the input signals;

filtering the digital signals to obtain first digital signals in the first frequency range and second digital signals in the second frequency range; and processing the first digital signals using a beamforming method based on Digital Signal Processing (DSP), to make the acoustic energy radiation generated by the first plurality of speakers greater in the first zone than in the second zone;

wherein the processed first digital signals are adapted to be input to the first plurality of speakers, and the second digital signals are adapted to be input to the second plurality of speakers.

11. The method according to claim 10, wherein the digital signals are filtered by a first filter and a second filter to obtain the first digital signals and the second digital signals respectively, and each of the second plurality of speakers comprises a tweeter and a horn connected with the tweeter, determining a crossover frequency of the first filter and the second filter comprises:

determining the interval between adjacent speakers in the row of the first plurality of speakers;

obtaining an upper frequency limit of the first plurality of speakers based on equation $$f_{ua} = \frac{c}{2\Delta x}, \tag{1}$$

where c is sound speed and Δx is the interval between the adjacent speakers in the row of the first plurality of speakers;

determining length of the horn;

obtaining a lower frequency limit of the second plurality of speakers based on equation (2):

$$f_{lh} = \frac{c}{4L_h}, \tag{2}$$

where c is sound speed and $L_h$ is the length of the horn;

determining the crossover frequency based on the upper frequency limit and the lower frequency limit; and determining whether the determined crossover frequency matches with a performance of the second plurality of speakers:

when the determined crossover frequency does not match the performance of the second plurality of speakers, repeating the steps of determining the crossover frequency;

when the determined crossover frequency matches the performance of the second plurality of speakers, the determined crossover frequency is determined to be the crossover frequency of the first filter and the second filter.

12. The method according to claim 11, wherein the crossover frequency ranges from 800 Hz to 5 kHz.

13. The method according to claim 10, further comprising:

obtaining first analog signals and second analog signals based on the processed first digital signals and the second digital signals; and amplifying the first analog signals and the second analog signals;

where the amplified first analog signals are adapted to be input to the first plurality of speakers and the amplified second analog signals are adapted to be input to the second plurality of speakers.

14. The method according to claim 10, wherein the first zone covers a side area of the row of the first plurality of speakers, the second zone covers an area in front or back of the row of the first plurality of speakers, the third zone covers an area where the openings of the second plurality of speakers face, and the fourth zone covers a side area of the second plurality of speakers.

15. An audio system, comprising:

a speaker apparatus, comprising a first plurality of speakers arranged at an interval in a row, and a second plurality of speakers symmetrically disposed at two sides of the row of the first plurality of speakers with openings at the two sides facing outwardly, where acoustic energy radiation generated by the first plurality of speakers is greater in a first zone than in a second zone in a first frequency range, acoustic energy radiation generated by the second plurality of speakers is greater in a third zone than in a fourth zone in a second frequency range, and the first frequency range overlaps with the second frequency range; and a processor, configured to process input signals of the speaker apparatus, comprising:

a first obtainment circuitry, configured to obtain digital signals based on the input signals;

a first filter, configured to filter the digital signals to obtain first digital signals in the first frequency range;

a second filter, configured to filter the digital signals to obtain second digital signals in the second frequency range; and a digital signal processing circuitry, configured to process the first digital signals using a beamforming method based on Digital Signal Processing (DSP), to make the acoustic energy radiation generated by the first plurality of speakers greater in the first zone than in the second zone;

wherein the processed first digital signals are adapted to be input to the first plurality of speakers, and the second digital signals are adapted to be input to the second plurality of speakers.

16. The audio system according to claim 15, wherein a crossover frequency of the first filter and the second filter ranges from 800 Hz to 5 kHz.

17. The audio system according to claim 15, further comprising:

a second obtainment circuitry, configured to obtain first analog signals and second analog signals based on the processed first digital signals and the second digital signals; and an amplifier, configured to amplify the first analog signals and the second analog signals;

where the amplified first analog signals are adapted to be input to the first plurality of speakers and the amplified second analog signals are adapted to be input to the second plurality of speakers.

18. The audio system according to claim 15, wherein the first zone covers a side area of the row of the first plurality of speakers, the second zone covers an area in front or back of the row of the first plurality of speakers, the third zone covers an area where the openings of the second plurality of speakers face, and the fourth zone covers a side area of the second plurality of speakers.

* * * * *